United States Patent [19]

MacMaster et al.

[11] 3,934,106

[45] Jan. 20, 1976

[54] MICROWAVE BROWNING MEANS

[75] Inventors: George H. MacMaster, Lexington; Kenneth W. Dudley, Sudbury, both of Mass.

[73] Assignee: Raytheon Company, Lexington, Mass.

[22] Filed: Aug. 14, 1974

[21] Appl. No.: 497,445

Related U.S. Application Data

[62] Division of Ser. No. 395,469, Sept. 10, 1973, Pat. No. 3,857,009.

[52] U.S. Cl. ..... 219/10.55 E; 219/10.55 F

[51] Int. Cl.[2] ..... H05B 9/06

[58] Field of Search .....126/390; 219/10.55 E, 219/10.55 F, 10.55 R, 10.55 A, 10.55 M

[56] References Cited

UNITED STATES PATENTS

| | | | |
|---|---|---|---|
| 2,612,596 | 9/1952 | Gross | 219/10.55 F |
| 3,271,169 | 9/1966 | Baker et al. | 219/10.55 E |
| 3,302,632 | 2/1967 | Fichtner | 219/10.55 E |
| 3,353,968 | 11/1967 | Krajewski | 219/10.55 E |
| 3,490,580 | 1/1970 | Brumfield et al. | 219/10.55 E |
| 3,525,840 | 8/1970 | Dreman | 219/10.55 A |
| 3,591,751 | 7/1971 | Goltsos | 219/10.55 E |
| 3,601,448 | 8/1971 | Stone | 219/10.55 M |
| 3,662,141 | 5/1972 | Schauer | 219/10.55 E |
| 3,740,514 | 6/1973 | Anderson | 219/10.55 F |
| 3,835,280 | 9/1974 | Gades et al. | 219/10.55 E |

*Primary Examiner*—Bruce A. Reynolds
*Attorney, Agent, or Firm*—Edgar O. Rost; Joseph D. Pannone; Harold A. Murphy

[57] ABSTRACT

Apparatus is disclosed for heating with microwave energy utilizing nonresonant means for converting and transforming free space plane waves within the oven enclosure into fringing electric field patterns to brown or sear the load surfaces similar to broiling. One embodiment comprises parallel abutting plates with alternate plates of a high dielectric constant material to provide a predetermined phase lag and with the intervening low dielectric constant sections to provide alternating fringing electric fields, illustratively, in the pi or any other desired mode pattern. Alternate embodiments include microwave strip transmission lines comprising conductive strips separated by a dielectric substrate to couple and convert the free space waves into the desired heating mode pattern. A load supporting shelf within the microwave oven may be readily adapted to include the alternating dielectric materials to provide the desired fringing electric field patterns. Conveyor belts may also be adapted to incorporate browning surface means by strips of a high dielectric material on the belt material. Further embodiments include microwave oven enclosures radiated by horn means which may be cross-polarized, as well as, the combination of horn radiators coupled to microwave browning plates.

3 Claims, 12 Drawing Figures

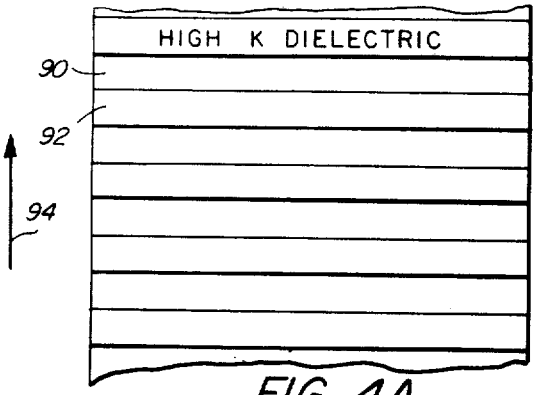
FIG. 4A
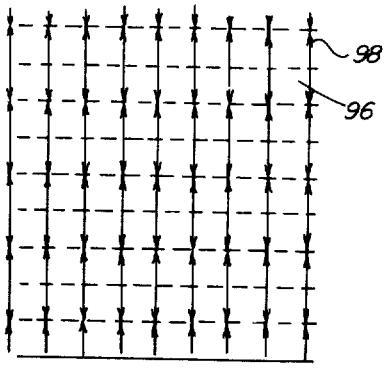
FIG. 4B
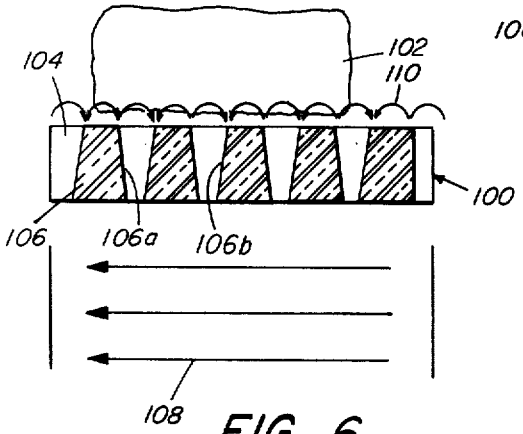
FIG. 6
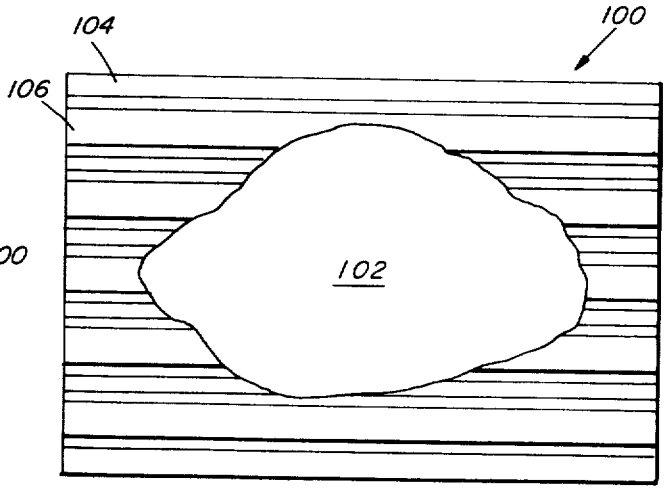
FIG. 5
FIG. 7
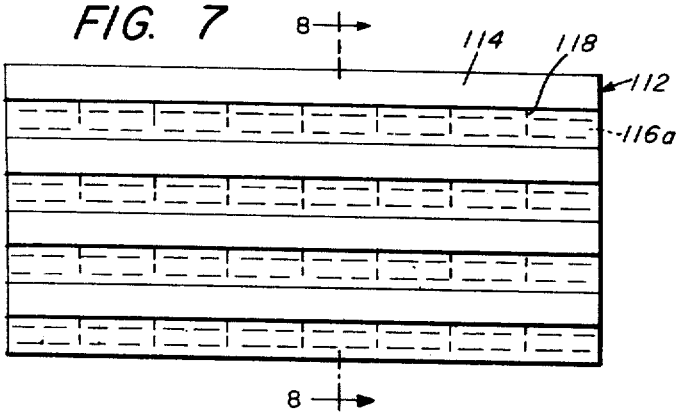
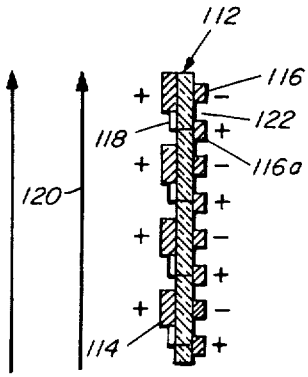
FIG. 8
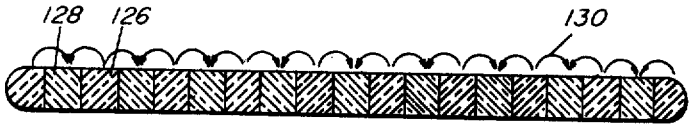
FIG. 9

MICROWAVE ROTISSIERIE
WITH RADIATORS

ROTISSIERIE WITH
RADIATORS AND BROWNING SHELF

MICROWAVE BROWNING MEANS

CROSS-REFERENCE TO RELATED APPLICATIONS

This is a division of application Ser. No. 395,469, filed Sept. 10, 1973, now U.S. Pat. No. 3,857,009.

BACKGROUND OF THE INVENTION

1. Field of the Invention

The invention relates to microwave heating and apparatus for producing broiled surfaces on a radiated load.

2. Description of the Prior Art

The heating of articles by microwave energy has become widely accepted both here and abroad in recent years due to the rapid preparation times resulting from the so-called "dielectric heating phenomenon." Such apparatus typically includes an energy source such as a magnetron with the energy fed within a conductive wall oven enclosure through waveguide transmission means. The electromagnetic waves are radiated and reflected within the enclosure in free space and are distributed by such means as mode stirrers to uniformly surround and be absorbed by the load to result in high frequency oscillatory movements of the molecules to cause heating by molecular friction. The allocated frequencies for such heating apparatus are assigned by the Federal Communication Commission and are 915± 13 MHz and 2450± 50 MHz. The term "microwaves" is intended to define electromagnetic energy radiation having wavelengths in the order of 1 meter to 1 millimeter and frequencies in the order of 300 MHz to 300 GHz.

All materials exposed to electromagnetic radiation have differing dielectric constant and loss tangent characteristics and, therefore, the rate of heating becomes a varying factor. Accordingly, the varying absorption of the radiated energy causes the depth of penetration and surface coloration of loads to vary. Where a browned surface is desired, similar to broiling, this is difficult to achieve without long exposure which results in overcooking of the interior regions because the microwave oven enclosure is cooler relative to electric and gas apparatus so that the exterior load surfaces tend to be cooler than the interior and there is heat loss due to evaporation of moisture. Microwave cooked exterior surfaces, therefore, have been treated in a slightly different manner to produce the desirable coloration.

Prior art techniques for browning include the incorporation of electric or gas broiling elements in the microwave oven. Another method involves the coating of the outer surfaces with a food additive having a higher energy absorbing characteristic which will lead to more rapid heating of the outer surfaces, while the remainder of the load achieves the desired degree of cooking. Still another example of prior art teachings involves the use of lossy ovenware or utensils having a selective heating capability by means of the use of conductive materials. Such conductive materials may be incorporated in a shelf of a dielectric material supporting the load or comprise radiating means having a plurality of rods with a pre-determined spacing to cause the rapid absorption of the microwave energy by the rods as shown in U.S. Pat. No. 3,591,751, issued July 6, 1971 to C. E. Goltsos U.S. Pat. No. 2,830,162, issued Apr. 8, 1958 to D. A. Copson et al., and assigned to the assignee of the present invention, utilizes a utensil of a ferromagnetic material responsive to the energy impinging thereon up to the Curie temperature point. Thereafter, the utensil becomes substantially nonresponsive and is pervious to the electromagnetic energy. Ferromagnetic materials sustain the alternating electric and magnetic fields and, characteristically have high energy loss at the temperatures below the Curie point. Such materials include alloys of manganese, tin and copper, or manganese, alumnium and copper as well as alloys of iron and sulphur, such as pyrrhotite, whose crystals have the form of hexagonal prisms. Examples of such materials are zircomates of lead and barium and the titanates of lead, barium and strontium.

Other examples of the prior art are found in U.S. Pat. No. 3,219,460 issued Nov. 23, 1965 to E. Brown which discloses containers of a dielectric material having electrically conductive shields such as aluminum wrapped completely around the side and bottom surfaces. Other geometric patterns are achieved in the aluminum foil. U.S. Pat. No. 3,302,632 issued Feb. 7, 1967 to E. C. Fichtner also relates to a plastic-type package having varying microwave transparent characteristics. Such containers are readily adaptable to the preparation of frozen foods, such as T.V. dinners.

The prior art radiant heaters, selected heating packaging and lossy utensils have been utilized, however, a need still exists for a simple, less costly apparatus which will not be subject to breakage; require additional cleaning or reduce the amount of power available for heating.

SUMMARY OF THE INVENTION

In accordance with the teachings of the present invention a plate, dish, shelf or any load supporting means is provided with substantially parallel alternating regions of varying dielectric characteristics to result in intense alternating electric fields in close proximity of a load with said fields rapidly decaying a short distance from the load surfaces. The pi-mode or electric fields 180° out-of-phase is an illustrative electric field pattern for browning the load surfaces. The free space electromagnetic waves within the oven enclosure are converted by the nonfrequency-responsive and nonresonant means comprising the dielectric members from plane waves into the desired alternating fringing electric field patterns. The alternate dielectric members of high dielectric constant materials provide a phase reversal or phase lag relative to the intervening low dielectric constant or air-filled members which provide a different propagation characteristic. There are no size limitations other than the oven enclosure and there is no frequency dependency so that the invention is readily adaptable to conveyor systems or complete shelves in addition to plates or utensils to provide the fringing field patterns.

Alternate embodiments of the invention may be realized using strip microwave transmission line techniques providing a capacitor effect between conductive strips on opposing sides of the dielectric substrate. A plane wave entering the bottom of the microwave coupling and transformer means will effectively charge all the conductive strips to convert the waves into the desired mode patterns. Alternatively, all the embodiments of the invention utilizing parallel plates or conductive strips of varying propagation characteristics may be disposed on both sides of the load to shorten the browning time. Ceramic materials having a high dielectric constant of 25–50 have been utilized in exemplary embodiments and a rule of thumb for the high dielectric materials for the energy coupling and transformer browning means to obtain the desired phase reversal would be to use a material having a dielectric value approximately equal to the square root of the dielectric constant value of the material being heated.

In all the embodiments it is noted that in view of the rapidly decaying fields a short distance from the load relatively little splattering or heat is generated along the oven walls. Further, the materials utilized can be readily cleaned and are of a more durable nature than the lossy type ovenware utilizing ferromagnetic materials which become very brittle and are easily broken at the temperatures encountered in the oven. The invention may also be adapted to any desired mode field patterns such as $TM_{01}$ which would be useful for illustratively baked potatoes. A rotisserie arrangement is also possible and horn radiators for feeding the microwave energy into the oven enclosure are utilized with the horns being cross-polarized. The microwave coupling and transformer means can also be used in combination to couple the energy from the feed means to further enhance the advantages of microwave cooking.

BRIEF DESCRIPTION OF THE DRAWINGS

Details of the illustrative embodiments of the invention will be described with reference to the accompanying drawings, wherein;

FIG. 4A is a top view of a partial portion of a conveyer belt embodiment utilizing the invention;

FIG. 4B is a diagramatic representation of the alternating fringing electric fields disposed in close proximity to the top surface of the embodiment of FIG. 4A;

FIG. 5 is a top view of a browning plate embodiment shown supporting a load;

FIG. 6 is an end view of the browning plate embodiment shown in FIG. 5;

FIG. 7 is a bottom view of a strip microwave transmission line embodiment of the invention;

FIG. 8 is a cross-sectional view taken along the line 8–8 in FIG. 7;

FIG. 9 is a cross-sectional view of an embodiment of the invention utilized as a shelf in a microwave oven;

DESCRIPTION OF THE PREFERRED EMBODIMENTS

Figure 1:
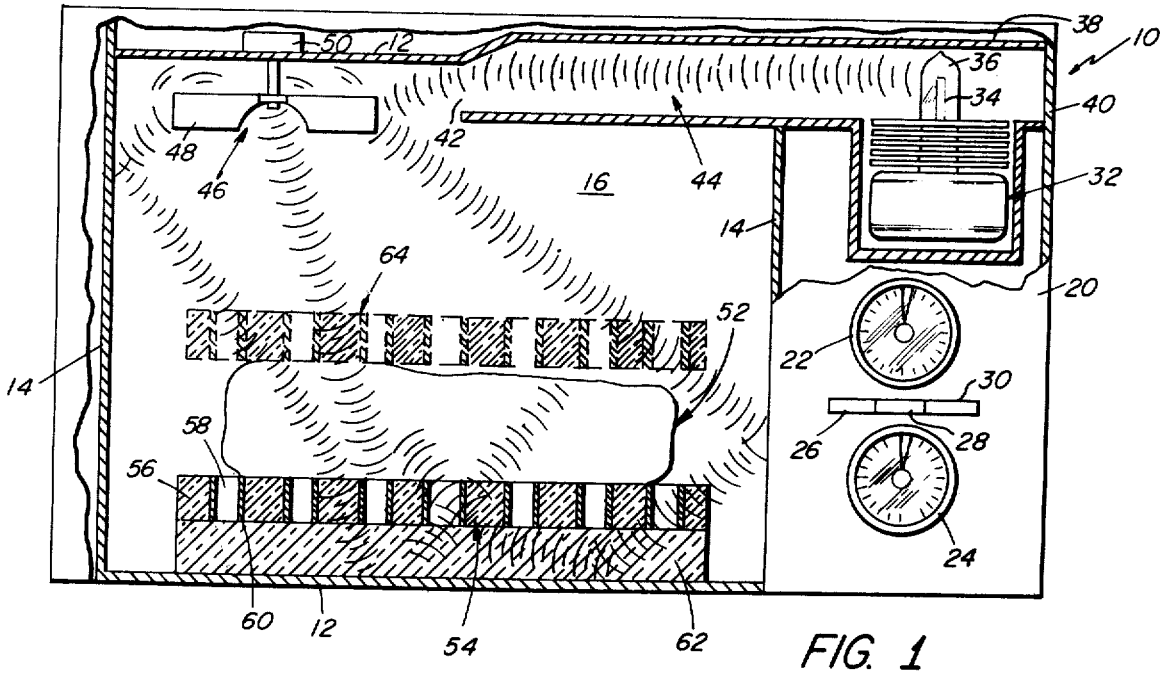
FIG. 1 is a vertical cross-sectional view of the microwave apparatus embodying the invention.

A typical microwave oven apparatus 10 found in the art today is illustrated in FIG. 1. Top and bottom conductive walls 12 define with sidewalls 14 the resonant oven enclosure 16 having predetermined dimensions to support a plurality of free space wavelengths at the apparatus operating frequency. At least one of the sidewalls 14 is provided with an access opening which is closed by means of a door and choke assembly commonly used in such apparatus of the side or bottom-hinged type. A case 18 surrounds the oven enclosure and is provided with a front panel member 20 for mounted timers 22 and 24, as well as, buttons 26, 28 and 30 for actuation, respectively, of the start, stop and light circuits.

A magnetron energy generator 32 of the type described in the text "Microwave Magnetrons," Radiation Laboratory Series, Volume 6, by G. B. Collins, McGraw-Hill Book Company, Inc., 1948 is mounted behind the front panel member. Such sources are energized by rectified line voltages of approximately 3,000 to 6,000 volts DC and the electrical circuits, as well as details of the energy source have been purposely omitted since they are considered to be well-known in the art. The microwave energy is coupled to the resonant cavity enclosure 16 by means of an antenna 34 within a dielectric member 36 extending into the launching rectangular waveguide 38. A terminating end wall 40 is disposed at one end of the launching means spaced approximately one-quarter of a wavelength from the antenna 34 for maximum launching efficiency. The opposing end is open as at 42 to provide for the radiation of the energy within the enclosure. Such launched energy represented by plane waves 44 is distributed in a cyclically varying manner by such means as a mole stirrer 46 having a plurality of vanes 48 which are rotated by a motor 50. The energy waves bounce off the conductive walls at the top, back, side and bottom of the oven enclosure. The load 52 to be heated and browned, such as a steak or roast, is supported on the energy coupling and transformer means 54 of the invention which converts the plane waves into the fringing electric field patterns of rapidly decreasing intensity in close proximity of the exterior surfaces of the load.

The browning means 54 comprise an arrangement of parallel plate members having varying dielectric characteristics with members 56 of a high dielectric constant value while the intervening spaces 58 may be filled with a low dielectric constant material or air. The spaces 58 are lined with a conductive material 60, such as copper or other metal tape to provide a capacitor effect. Where desired the energy coupling and transformer browning plate means 54 is supported on a spacer 62 of a microwave permeable material having a thickness to provide for the entrance of the plane bouncing waves from the bottom wall 12. The invention is also practiced by the provision of another microwave coupling and transformer browning plate means 64 on the opposing side of the load 52 to thereby simultaneously brown both sides of the product.

Figure 2:
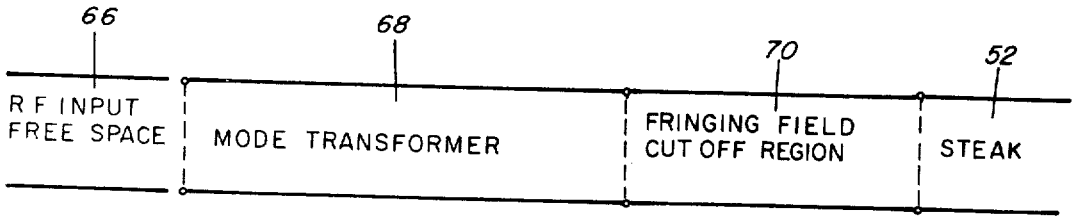
FIG. 2 is a diagramatic representation to assist in the understanding of the invention.
Figure 3:
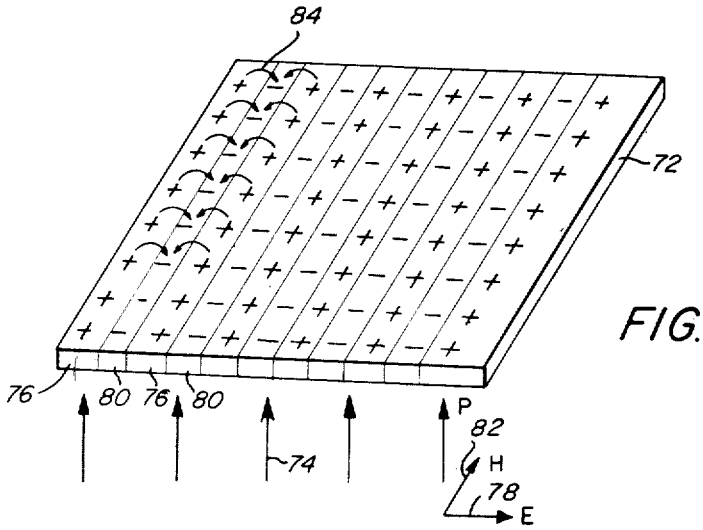
FIG. 3 is a diagramatic representation of a browning plate embodiment of the invention illustrating the alternating fringing electric field orientation along the top surface.

Referring now to FIG. 2 the principle of the invention will be explained. Plane wave 44 distributed within enclosure 16 have no specific field orientations and have a wavelength of approximately 4.8 inches for 2450 $MH_z$. From the free space region 66 the plane waves are coupled by mode transformer region 68 to evolve the fringing electric fields 70 adjacent to the steak 52. It is noted that the function of transforming of free space waves into the fringing electric field patterns may be achieved by an integral assembly or the mode transformer portion may be separate with a superimposed top plate member. With the invention essentially all of the energy entering the transformer region 68 is transformed into a desired heating pattern, illustratively, the pi-mode where the electric fields alternate 180° out-of-phase as shown diagramatically in FIG. 3.

In this view the assembly comprises a plurality of parallel plates stacked together in an array with alternate plates providing a high dielectric constant to obtain a desired degree of phase reversal or phase lag for the resultant pattern. To obtain this fringing field configuration plane waves, indicated by vectors 74, enter the bottom of the browning plate means 72 and in the low dielectric constant or air-filled regions 76 a field orientation (+) and E-field vector 78 is obtained extending perpendicular to the direction of transport of the plane waves. Alternate parallel plates 80 are provided of a high dielectric material such as K-50 or the material sold under the name Stycast with the electric field orientations now reversed as shown by vectors 78. In the reorientation of the plane waves, the H or magnetic field vector extends in an orthogonal direction, designated by the vector 82, parallel to the longitudinal axis of the plate 72. The alternating fringing electric fields are indicated by arrows 84. These fringing field patterns are of high intensity adjacent to the top surface of the plate 72 and decay rapidly in a direction perpendicular to the plate. Unique means for achieving rapid browning and searing of the exterior surfaces of load are thereby achieved utilizing the structure of the invention.

Referring next to FIGS. 4A and 4B another embodiment of the invention will be discussed. A conveyor belt 90 of a dielectric material having good microwave transmission characteristics is provided with a plurality of high dielectric constant material strips or a coating at alternate intervals, with the strips extending transversely to the direction of travel of the conveyer, as indicated by the arrow 94. The invention is not restricted to the transverse disposition of the alternating dielectric material and the array, therefore, may be disposed extending parallel to the direction of travel of the conveyer. FIG. 4B indicates by means of arrows 96 the disposition of the fringing electric fields in the region of the exposed conveyer dielectric material while arrows 98 indicate the phase reversal provided by the high dielectric constant regions 92. It is common in conveyorized systems to have the energy distributed from a position above or below the conveyer belt as desired. In either case the invention will provide the fringing electric fields in close proximity to the conveyer belt surfaces.

In FIG. 5 a microwave browning plate means 100 is illustrated carrying a load 102 which is capable of being readily inserted and removed from the oven enclosure. The parallel plates 104 define the regions of low dielectric constant material which is readily permeable to microwave energy and parallel plate members 106 comprise the high dielectric constant material. In FIG. 6 the configuration of the high loss dielectric members 106 will be noted having slightly tapered surfaces **106*a* and 106*b*. The waves represented by the E-vectors 108 entering the bottom portion are coupled and transformed into the fringing fields exiting from the top surface as represented by the arrows 110. It will be noted that the fringing electric fields adjacent to load 102 extend a short distance from the top surface and, therefore, the desired browning effect is readily obtained on the exterior surfaces of the load 102. FIGS. 7 and 8 represent a strip microwave transmission line embodiment of the invention. A dielectric substrate body 112 is provided on the bottom side with parallel strips 114 of a highly conductive material such as copper. The upper portion of the substrate 112 is provided with twice as many conductor strips 116. Alternate conductive strips 116*a* are connected to the bottom strips 114 by wires 118 to thereby achieve an alternating electric field as indicated by the + and − signs of the alternate upper strip members. The unconnected strips form capacitors with the bottom conductive strips 114. Plane waves fed into the bottom as indicated by the E-vectors 120 charge all the conductive strips 114 on the bottom side at the same potential. The unconnected strips 116 on the top which are separated by spaces 122** result in an out-of-phase fringing electric field being established across the top surface in the alternating pi-mode. This configuration of the invention represents a low cost method of making a non-reasonant means for coupling and transforming microwave energy into any desired fringing electrical field pattern.

FIG. 9 illustrates an alternative embodiment of the invention comprising a shelf member 124 made up of alternate parallel plate sections of dielectrics 126 and 128. Such an embodiment is mounted on brackets attached to the oven enclosures sidewalls 14 to space the shelf at any desired height from bottom walls 12. Parallel sections 126 comprise the low dielectric constant material while the intervening sections 128 comprise the high dielectric constant material. The fringing electric fields provided by this arrangement are indicated by the arrows 130.

Figure 10:
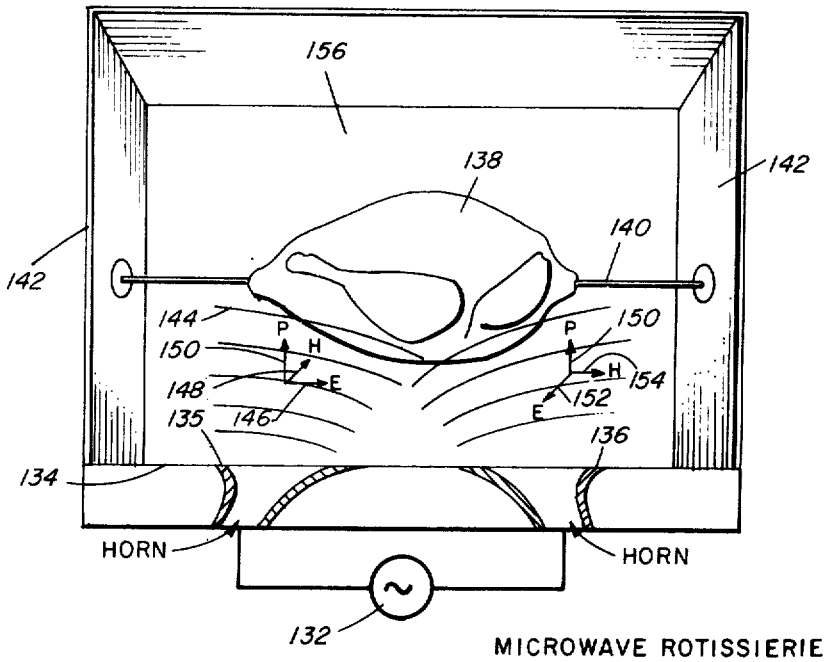
FIG. 10 is a perspective view of a microwave oven adapted for a rotisserie and radiated by horn-type radiators with cross-polarized fields.
Figure 11:
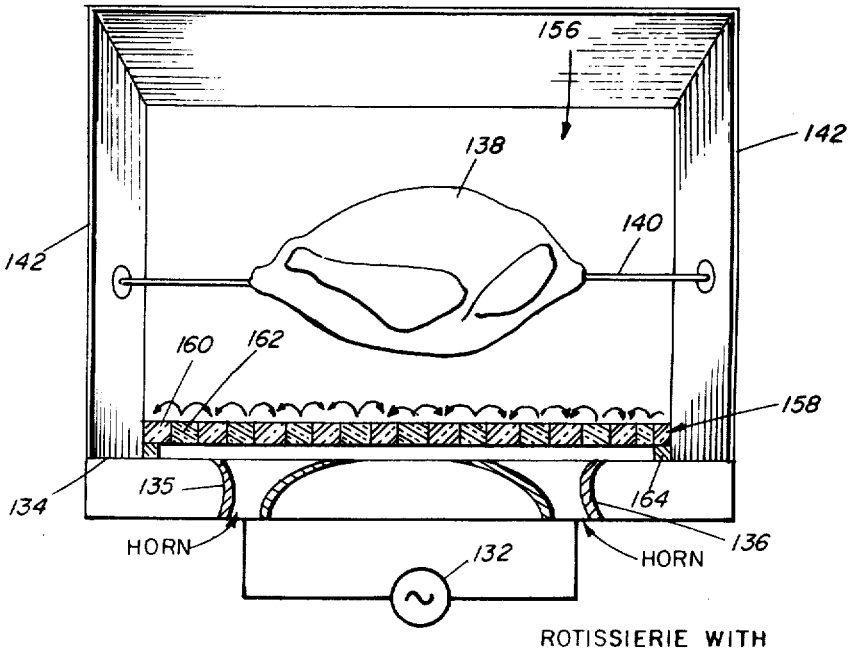
FIG. 11 is a perspective view of the apparatus shown in FIG. 10 in combination with the microwave coupling and transformer browning means embodying the invention.

FIGS. 10 and 11 illustrate another embodiment of a microwave oven apparatus with the microwave energy from a source 132 fed through the bottom wall 134 by means of horn radiators 135 and 136. The load 138 comprising a fowl is supported on a rotisserie arrangement including a rod member 140 supported by the sidewalls 142 and actuated by motor means (not shown). In this embodiment the energy radiated from horn 135 comprises radiated waves 144 with the energy polarized in a direction to provide the E-vector 146 and the H-vector 148. These vectors are the orthogonal components of the plane wave indicated by vector 150. The adjacent horn radiator 136 also provides for the radiation of a polarized wave in the direction indicated by the vector 150. This radiator, however, is structured to provide for a different polarization of the energy so that the E-vector 152 and H-vector 154 are approximately 90° out-of-phase with the orthogonal distribution from the radiator 135.

In this embodiment the oven enclosure 156 may be larger than present day microwave ovens since the energy is radiated directly from the radiators 135 and 136 and the distribution effectively controlled by the angle of radiation. The energy reflected from the surfaces of the load 138 as the load rotates are redirected into the meat because of the reflection from the oven enclosure walls. In FIG. 11 a microwave plate member 158, similar to that described in FIG. 9, having alternate dielectric constant material members 160 and 162 is supported on brackets 164. Parallel plate regions 160 represent the high dielectric constant material and the intervening members 162 represent the low dielectric constant material.

It is evident that numerous other variations, modifications and alterations may be practiced by those skilled in the art, for example, it is possible to provide an energy coupling and transformer browning means with a $TM_{ol}$ mode field pattern. Such a pattern would be suited for baking potatoes. It is intended, therefore, that the foregoing description of the embodiment of the invention be considered broadly and not in a limiting sense.

We claim:

1. A utensil for microwave heating comprising:

a base member having regions of alternately high and low dielectric constant characteristics to provide a fringing electric field pattern having a substantially 180° phase differential adjacent to a surface of said member when exposed to radiating free space electromagnetic wave energy.

2. A utensil according to claim 1 wherein said base member comprises an array of high dielectric constant materials with alternate intervening spaces with a coating of a conductive material disposed on the walls of said dielectric members bounding said spaces.

3. The utensil according to claim 1 wherein said base member comprises a dielectric substrate body having spaced conductive strips on opposing sides interconnected to provide the predetermined fringing electric field pattern.

* * * * *